United States Patent [19]

Ingram

[11] Patent Number: 4,866,212

[45] Date of Patent: Sep. 12, 1989

[54] LOW DIELECTRIC CONSTANT REINFORCED COAXIAL ELECTRIC CABLE

[75] Inventor: Glenn B. Ingram, Flagstaff, Ariz.

[73] Assignee: W. L. Gore & Associates, Inc., Newark, Del.

[21] Appl. No.: 173,225

[22] Filed: Mar. 24, 1988

[51] Int. Cl.[4] ..... H01B 11/18; H01B 7/02

[52] U.S. Cl. ..... 174/28; 174/29; 174/110 FC; 174/110 F; 333/243

[58] Field of Search ..... 174/28, 29, 110 F, 110 FC; 333/243

[56] References Cited

U.S. PATENT DOCUMENTS

| | | | |
|---|---|---|---|
| Re. 20,244 | 1/1937 | Peterson | 174/28 |
| 2,197,616 | 4/1940 | Lehne et al. | 174/29 |
| 2,348,752 | 5/1944 | Quayle | 174/29 |
| 3,227,800 | 1/1966 | Bondon | 174/29 |
| 3,287,490 | 11/1966 | Wright | 174/28 |
| 3,745,232 | 7/1973 | Johnson et al. | 174/110 F X |
| 4,332,976 | 6/1982 | Hawkins | 174/29 X |
| 4,408,089 | 10/1983 | Nixon | 333/243 X |
| 4,560,829 | 12/1985 | Reed et al. | 174/110 F X |
| 4,626,810 | 12/1986 | Nixon | 174/110 F X |
| 4,758,685 | 7/1988 | Pote et al. | 174/29 |

FOREIGN PATENT DOCUMENTS

| | | | |
|---|---|---|---|
| 485946 | 5/1938 | Fed. Rep. of Germany | 174/29 |

*Primary Examiner*—Morris H. Nimmo

*Attorney, Agent, or Firm*—John S. Campbell

[57] ABSTRACT

A reinforced coaxial electric cable having low dielectric constant and a layer of convoluted dielectric insulation placed between either center conductor and conductive shield, optional porous dielectric and shield, or shield and jacket. FEP convoluted dielectric and expanded polytetrafluoroethylene insulation.

7 Claims, 2 Drawing Sheets

LOW DIELECTRIC CONSTANT REINFORCED COAXIAL ELECTRIC CABLE

FIELD OF THE INVENTION

The present invention relates to the field of coaxial electric cables which are insulated by materials having as low a dielectric constant as possible or as near to the value 1.0 of a layer of air as can be obtained.

BACKGROUND OF THE INVENTION

A coaxial cable most often comprises an inner metallic signal conductor, a dielectric system surrounding the inner conductor, and an outer electrically conductive shield member surrounding the dielectric system. A suitable electrically conductive metal such as copper or a copper alloy, aluminum, or an iron alloy, such as steel, is used as the center signal conductor and in the form of a tube, a braided mesh or jacket, or as a layer of dielectric tape is used to surround the exterior of the cable as a shield against extraneous electric signals or noise which might interfere with any signals being carried by the center conductor.

The best available dielectric, theoretically, which could be used would be air, which has a dielectric constant of 1.0. Since it is almost impossible to construct a cable having only an air dielectric, practical cables of use in commerce must utilize materials and/or constructions allowing an approach as close as is possible to a dielectric constant of 1.0, while at the same time retaining adequate strength, flexibility, waterproofness, other desirable electrical properties in addition to minimum dielectric constant, and other properties of value in the art of coaxial electric cables.

The approach of foaming a dielectric, such as polyethylene about the center conductor, then surrounding the foam by unfoamed dielectric has been taken by Gerland, et al, in U.S. Pat. No. 3,516,859 and Griemsmann in U.S. Pat. No. 3,040,278. A spiral rib made from dielectric material was wound about a conductive center core to space the core from a dielectric or conductive metal tube surrounding and concentric with the conductive core by Saito, et al in U.S. Pat. No. 4,346,253, and Hildebrand, et al, in U.S. Pat. No. 3,286,015, to provide as much air dielectric as possible surrounding the conductive signal center core. Dielectric strands have been wound spirally about conductive center cores for the same purpose by Lehne, et al, in U.S. Pat. No. 2,197,616, Hawkins, in U.S. Pat. No. 4,332,976, Bankert, Jr., et al, in U.S. Pat. No. 3,750,050, in a waveguide structure, and by Herrmann, Jr., et al, in U.S. Pat. No. 4,018,977, in high voltage power cable. Disc type spacers have also been tried, being strung at intervals down a conductive center wire leaving air between them. This and some of the other constructions, however, lack mechanical strength, particularly when a cable is bent, and use of more material to add strength also increases weight and bulk, which is detrimental for many uses, such as space devices or computer equipment.

SUMMARY OF THE INVENTION

The present invention comprises a low dielectric constant reinforced coaxial electric cable having convoluted dielectric insulation. The convoluted insulation may be used by itself along with air to insulate the cable or may be used in combination with porous expanded polytetrafluoroethylene. A preferred material to comprise the convoluted insulation is fluorinated ethylene propylene copolymer (FEP).

DESCRIPTION OF THE PREFERRED EMBODIMENTS

Figure 1:
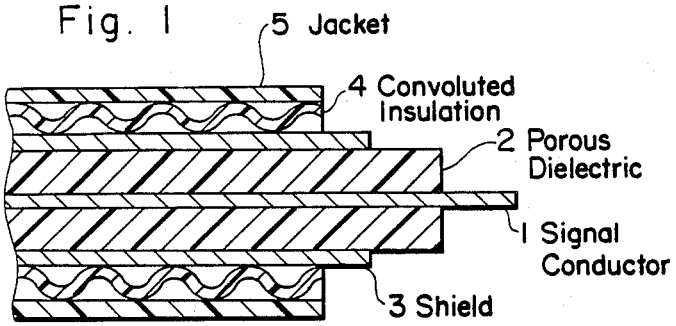
FIG. 1 shows a cross-section of a coaxial electric cable having a layer of convoluted insulation outside the shield beneath the outer protective jacket.

The invention can be better understood from the following detailed description and accompanying drawings. Referring now to the drawings, FIG. 1 describes a cross-section of a coaxial electric cable, wherein the center or signal carrying conductor 1 is surrounded by a layer of highly porous dielectric 2 containing about 60 to about 95% or more air space, the remainder being the preferred expanded polytetrafluoroethylene or an alternative highly porous polymeric plastic dielectric, such as porous polypropylene, porous polyurethane, or a porous fluorocarbon other than expanded polytetrafluoroethylene. Dielectric 2 may be appropriately applied to conductor 1 by tapewrapping, extruding, foaming, or other means known in the art. Surrounding dielectric 2 is shield 3 which may be of braided conductive metal wire or tape or metallized tape wrapped about dielectric 2 in layers to build up shield 3. Extruded over shield 3 is a spiralled convoluted FEP dielectric layer 4.

FEP is the preferred thermoplastic dielectric for the convoluted layer, but other thermoplastic fluorinated plastics could be used, such as PFA, polyvinylidene fluoride, ethylene-tetrafluoroethylene copolymers, or other thermoplastics such as polypropylene, polyethylene, polyamide, polyurethane, polyester, or silicone to name a few. The thermoplasticity allows machine extrusion and spiral convolute tube formation about the interior portions of the cable. The cable is completed by extrusion of a protective polymeric jacket 5 over convoluted layer 4. Jacket 5 may be made of a thermoplastic polymer such as polyvinylchloride, polyethylene, or a polyurethane rubber. In the case of the cable of FIG. 1, spiralled convoluted dielectric Layer 4 acts only as a reinforcing agent which controls cable diameter so electrical properties within the cable may be controlled.

Figure 2:
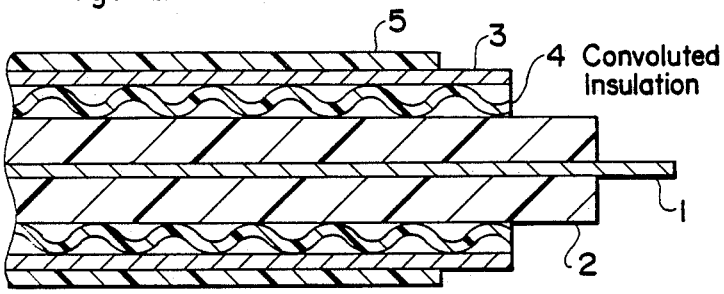
FIG. 2 is a cross-section wherein the convoluted insulation layer lies between a layer of expanded polytetrafluoroethylene insulation and the shielding layer.

FIG. 2 shows an alternative placement for spiralled convoluted layer 4 in the cable, being placed between porous dielectric 2 and shield 3 where it decreases the dielectric constant of the cable and acts as a reinforcement to prevent crushing and kinking of low density cable.

An example of a cable according to FIG. 2 was prepared from a 12 gauge 19 strand 0.0895 inch diameter silver plated copper center conductor tapewrapped with 0.6 to 0.7 grams/cubic centimeter density porous expanded polytetrafluoroethylene tape to an outside diameter of 0.157 inches. The completed cable had a measured dielectric constant of 1.28.

Figure 3:
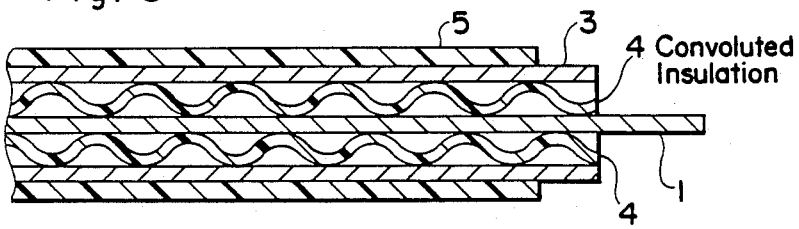
FIG. 3 depicts a cross-section of cable wherein a layer of convoluted insulation is utilized as the sole dielectric between the conductive center core and the shielding layer.

A second alternative is illustrated in FIG. 3, where spiralled convoluted insulation is used by itself as the dielectric 4 between the center or signal conductor 1 and the conductive shield 3 of the cable. This design provides a cable having considerable crush resistance.

An example of a cable according to FIG. 3 was prepared from a 0.125 inch solid aluminum conductor which had snugly fitted around it a convoluted FEP tube of 0.155 to 0.157 inch wide diameter and 0.298 to 0.302 inch outside diameter. A standard shield was braided over this tube of 3401 gauge tin plated copper at four ends. This cable had a measured dielectric constant of 1.20–1.24. Another similar cable made from a 0.156 inch solid stainless steel conductor, the other parameter being the same, tested to have a measured dielectric constant of 1.30.

Figure 4:
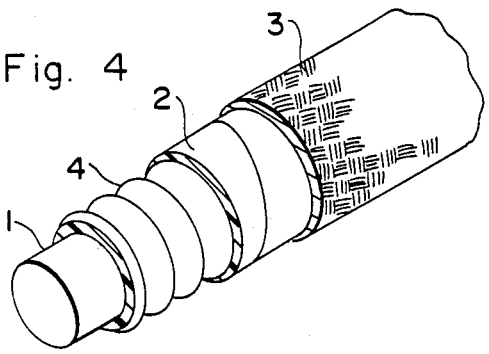
FIG. 4 is a perspective view of a peeled-back cable having a layer of convoluted insulation surrounding the center conductor, a layer of expanded polytetrafluoroethylene insulation applied over the convoluted insulation, and a braided shield over the expanded polytetrafluoroethylene layer.
Figure 5:
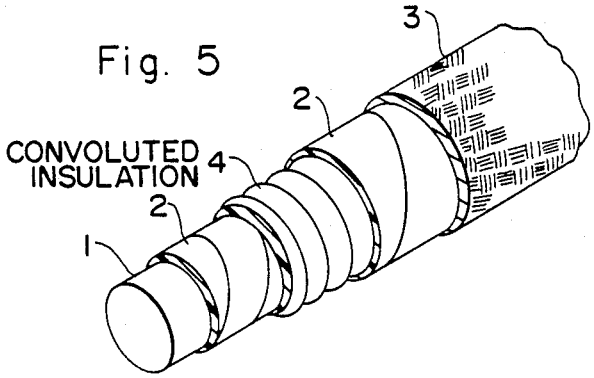
FIG. 5 is a perspective view of a peeled-back cable having a layer of expanded polytetrafluoroethylene insulation over the center conductor, then a layer of convoluted insulation followed by another layer of expanded polytetrafluoroethylene insulation and the braided shield.

FIGS. 4 and 5 describe yet another useful variation or alternative form of the invention where a layer of expanded polytetrafluoroethylene insulation 2 has been tapewrapped around convoluted layer 4 before braided shield 3 is applied to the cable. FIG. 5 also shows the alternative of having a layer of expanded polytetrafluoroethylene insulation 2 wrapped around the center conductor 1 before the convoluted insulation 4 is applied. The addition expanded polytetrafluoroethylene tends to lower the dielectric constant of the cable.

Although the much preferred form of convoluted insulation utilized in the invention is provided in spiralled form, greatly preferred where the cable is to be bent, it can be contemplated that non-spiralled convoluted insulation would provide most of the advantages of the spiraled form of insulation so far as insulation properties are concerned, but would be far less useful for resisting the detrimental effects of bends and twists upon the coaxial electric cables with which we are presently concerned, and would provide far less crush strength. Convolution yields 300–400% increase in compression strength. Additionally, other shapes and forms of spiral than round, as illustrated, may be equally useful, such as square or angular shaped spiral ridges, or other shapes of spiral ridges which would be known to those knowledgeable in the art.

Other changes and modifications may be made within the scope of the invention, the bounds of which are delineated by the appended claims.

I claim:

1. A reinforced coaxial electric cable having low dielectric constant comprising:
   (a) a conductive metal center conductor;
   (b) surrounding said center conductor, spaced therefrom, and insulated therefrom an electrically conductive metal shield;
   (c) a layer of convoluted electric insulation surrounding said center conductor; and
   (d) a layer of expanded polytetrafluoroethylene surrounding said center conductor.

2. A cable of claim 1, wherein said convoluted insulation lies outside said shield.

3. A cable of claim 1, wherein said convoluted insulation lies outside the layer of expanded polytetrafluoroethylene insulation surrounding said center conductor and inside said shield.

4. A cable of claim 1, wherein said convoluted insulation lies inside the layer of expanded polytetrafluoroethylene insulation surrounding said center conductor and inside said shield.

5. A cable of claim 1, wherein a layer of expanded polytetrafluoroethylene insulation lies both inside and outside said layer of convoluted insulation and both said expanded polytetrafluoroethylene layers lie inside said shield.

6. A cable of claim 1, wherein said convoluted insulation is spiralled and thermoplastic.

7. A cable of claim 6, wherein said convoluted insulation is fluorinated ethylene-propylene copolymer (FEP).

* * * * *